United States Patent [19]

Hori

[11] 4,277,335

[45] Jul. 7, 1981

[54] EXPANSION AND CONTRACTION DRIVE APPARATUS

[76] Inventor: Mitutaka Hori, 3128-5, Koizumi-cho, Yamatokohriyama-shi, Nara-ken, Japan

[21] Appl. No.: 37,093

[22] Filed: May 8, 1979

[30] Foreign Application Priority Data

Aug. 11, 1978 [JP] Japan ..... 53-111413[U]

[51] Int. Cl.[3] ..... E02B 5/08

[52] U.S. Cl. ..... 210/159; 198/517

[58] Field of Search ..... 198/517, 520, 550, 616, 198/736, 740; 414/304, 595, 639, 718; 212/55, 144, 46 B; 210/159, 162, 154; 52/118, 121

[56] References Cited

U.S. PATENT DOCUMENTS

| | | | |
|---|---|---|---|
| 2,335,573 | 11/1943 | Scott | 210/159 |
| 3,534,867 | 10/1970 | Johnston et al. | 212/55 |
| 3,591,006 | 7/1971 | Daferner et al. | 210/159 |
| 3,638,806 | 2/1972 | Hippach | 52/121 |
| 4,169,338 | 10/1979 | Elk | 212/144 |

FOREIGN PATENT DOCUMENTS

| | | | |
|---|---|---|---|
| 731322 | 9/1932 | France | 210/162 |

*Primary Examiner*—Joseph E. Valenza
*Attorney, Agent, or Firm*—George B. Oujevolk

[57] ABSTRACT

The present invention relates to an expansion and contraction system of a plurality of arms, and for example to an expansion and contraction system applicable to a rake arm of a dirt remover for discharging dust from the effluent of an aqueduct. The expansion and contraction system of the arm comprises a plurality of relatively slidably assembled pipes having different diameters respectively and a plurality of moving means each provided with a chain, such as an endless tension member and the like, extended between a pair of sprockets, such as guide wheels and the like, each moving means being provided in each pipe of the expansible and contractible arm, the spindle of the sprocket of each adjacent moving means being secured to a part of the endless chain of each opposite moving means, the pipe located at one end of the expansible and contractible arm being coupled with a conveyor frame of the moving means provided in said pipe, thereby enabling to rotationally drive the terminal sprocket of the moving means provided in the pipe at the other end of the expansible and contractible arm.

2 Claims, 15 Drawing Figures

EXPANSION AND CONTRACTION DRIVE APPARATUS

BACKGROUND OF THE INVENTION

The invention relates to an expansion and contraction system of a plurality of arms, and for example to an expansion and contraction system applicable to a rake arm of a dirt or dust remover for discharging dirt or dust from the effluent of an aqueduct.

BRIEF DESCRIPTION OF THE PRIOR ART

Generally, it has been a common practice to expand and contract an arm consisting of a plurality of relatively slidably assembled pipes each having a different diameter by means of a cylinder. Such drive means comprising a cylinder with a pressure source, such as a hydraulic pump and the like, and a switch bulb mounted intermediately on a pipe connecting the pressure source and the cylinder with each other. Thus, the installation involved a great deal of trouble. Moreover, since the arm was expanded and contracted starting from the pipe connected to a piston rod in association with the reciprocation thereof, not only the expansion and contraction were slow but also the assembling necessitated a great deal of labor due to the complicated construction.

Particularly in case of a dust remover in which the rake arm was adapted to move upwardly and downwardly by the drive of a chain moving means, the lower part of the chain conveyor was submerged under the effluent. Thus, the sprockets, sprocket spindles, bearings and the like in the lower part of the chain moving means were susceptible to corrosion. The conventional system, therefore, had a further disadvantage in that the replacement of the damaged parts involved additional cost and labor.

The invention has for an object to provide an improved drive apparatus for the expansion and contraction of the arm which can be assembled with simplicity and enables to obtain quick expansion and contraction of said arm.

Preferred embodiments of the invention will now be described in detail in reference to the accompanying drawings.

DETAILED DESCRIPTION

Figure 1:
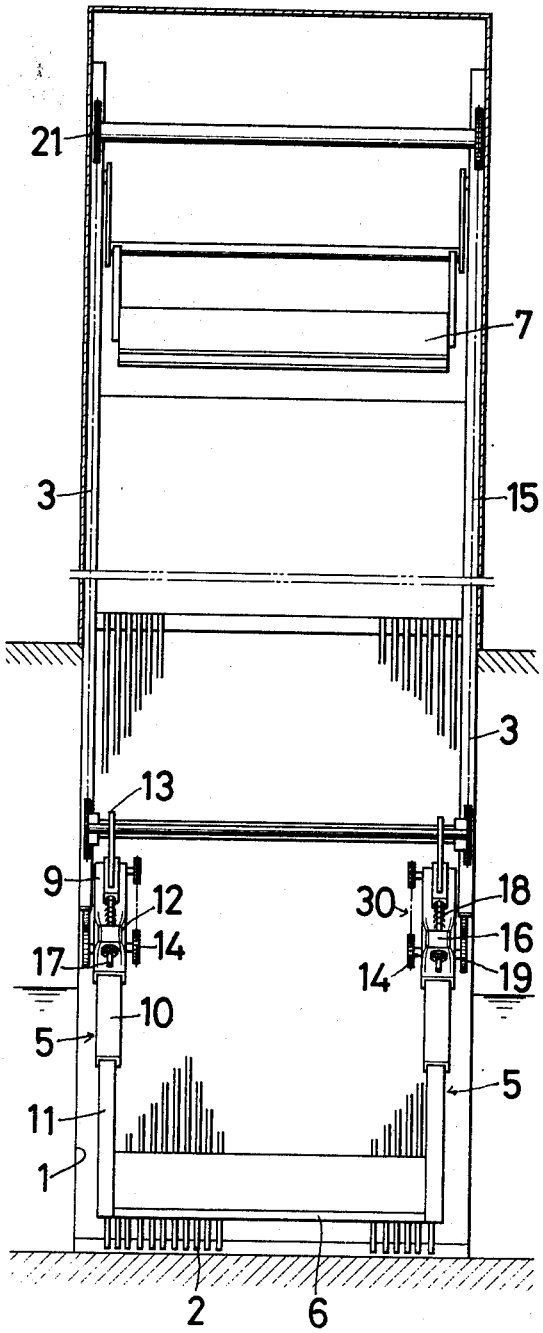
FIG. 1 is an elevation, with omission in part, of a dust remover provided with the arm expansion and contraction system according to the invention.

Each embodiment of the arm expansion and contraction system according to the invention when applied to a dust remover will hereafter be described in detail. A First Embodiment FIGS. 1 through 3 show a drive apparatus for expansion and contraction according to the invention applied to a dust remover.

The lower part of a bar screen 2 of the dust remover is submerged under the effluent of an aqueduct 1, a pair of chain moving means 3 being provided on the upstream side of the bar screen 2, a rake claw 6 being provided between the lower ends of a pair of expansible and contractible rake arms 5 capable of vertically reciprocating along guide grooves 4 respectively, dust collected on the upstream side of the bar screen 2 being scraped upwardly of the effluent 1 by the rising rake claw 6, the dust being discharged into a chute 8 by a wiper 7 adapted to oscillate when pushed by the rake claw 6. The expansion and contraction system of the rake arm 5 will be described hereinunder.

Figure 4:
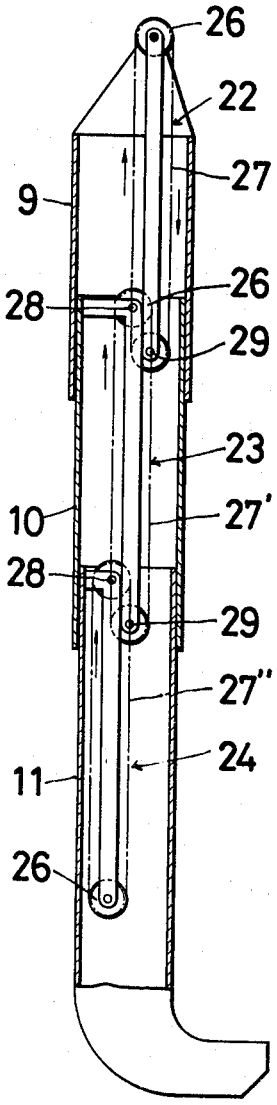
FIG. 4 is a longitudinal sectional elevation of a rake arm.
Figure 5:
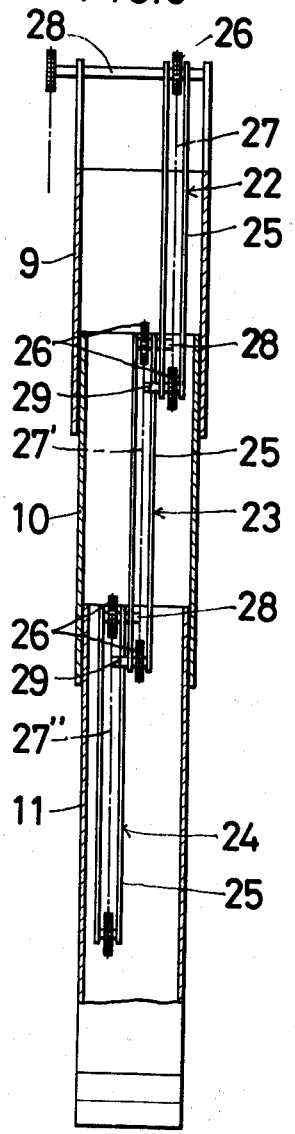
FIG. 5 is a longitudinal sectional sideview of FIG. 4.

As shown in FIGS. 4 and 5, the rake arm 5 is expansibly and contractibly formed with an intermediate pipe 10 fitted into an outer pipe 9 and an inner pipe 11 fitted into the intermediate pipe 10, the rake claw 6 being provided between the end of each inner pipe 11.

Figure 2:
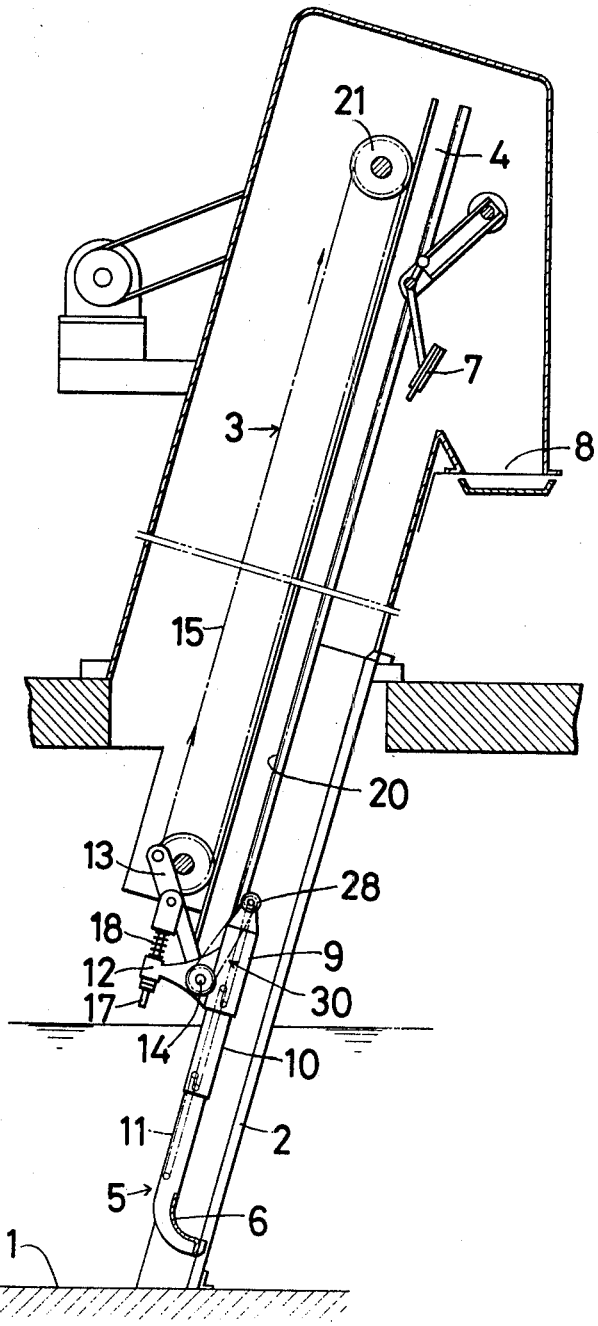
FIG. 2 is a longitudinal sectional side view of FIG. 1.
Figure 3:
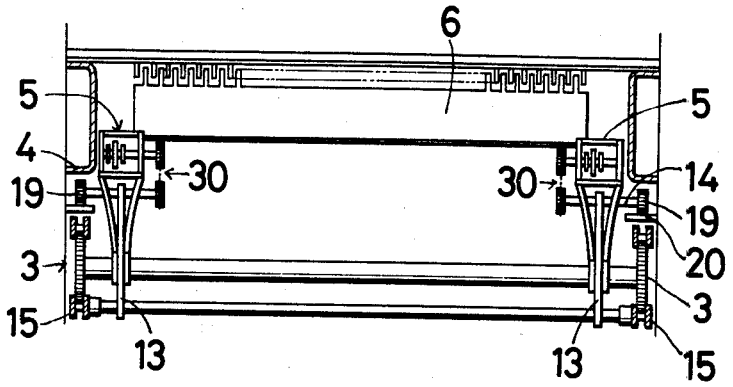
FIG. 3 is a horizontal sectional plan view of FIG. 1.

As shown in FIGS. 1 through 3, a pair of plate members 12 are mounted on one side of the outer periphery of the outer pipe 9 of the rake arm 5, the intermediate parts of the plate members 12 being connected with one end of a link 13 by a spindle 14, the other end of the link 13 being secured to the chain 15 of the chain moving means 3. Furthermore, a tubular member 16 is secured between the ends of each pair of plate members 12, one end of a guide member 16 being connected with the intermediate part of the link 13, a spring 18 for urging the link 13 upwardly being provided on the outside of the guide rod 17.

As shown in FIG. 3, the spindle 14 connecting the link 13 and the plate members 12 is provided with a pinion on one end thereof projecting into the guide groove 4, a rack 20 meshing with the pinion 19 being provided on one side of the guide groove 4.

Referring to FIG. 2, if the chain 15 of the chain conveyor 3 is displaced in the direction indicated by arrow, the rake claw 6 move upwardly along the bar screen 2. When the joint between the link 13 and the chain 15 travels around the upper periphery of an upper sprocket 21 of the chain moving means 3, the lower end of the rake arm is rotated about the spindle 14 leftwardly in FIG. 2 and lowered in that state.

Figure 6:
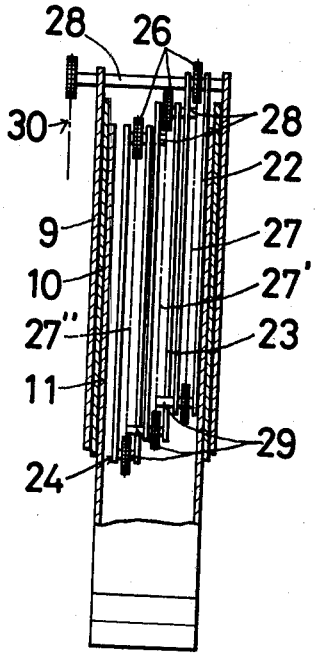
FIG. 6 is a longitudinal sectional side view showing the state of contraction of the rake arm of FIG. 5.
Figure 7:
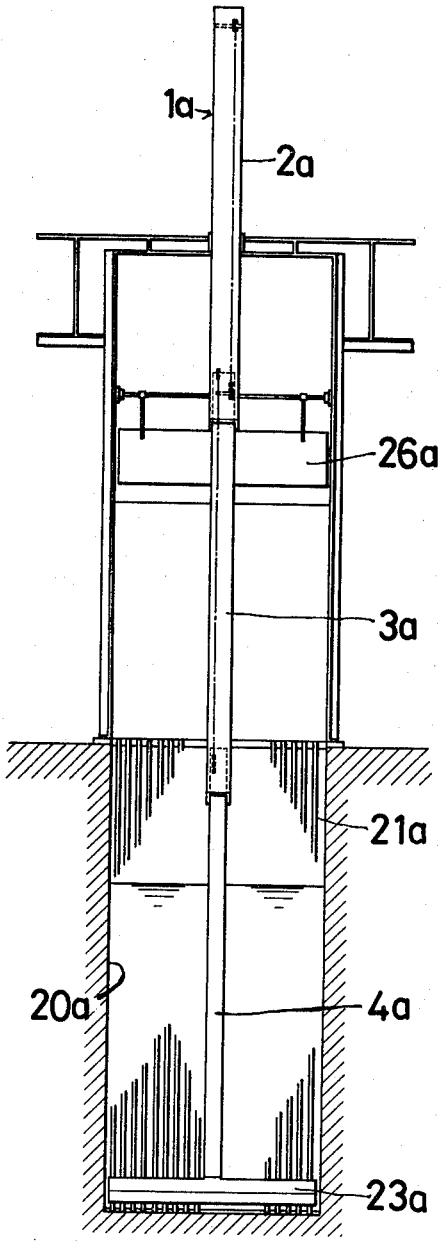
FIG. 7 is a longitudinal sectional view of a dust remover provided with another embodiment of the arm expansion and contraction system.
Figure 8:
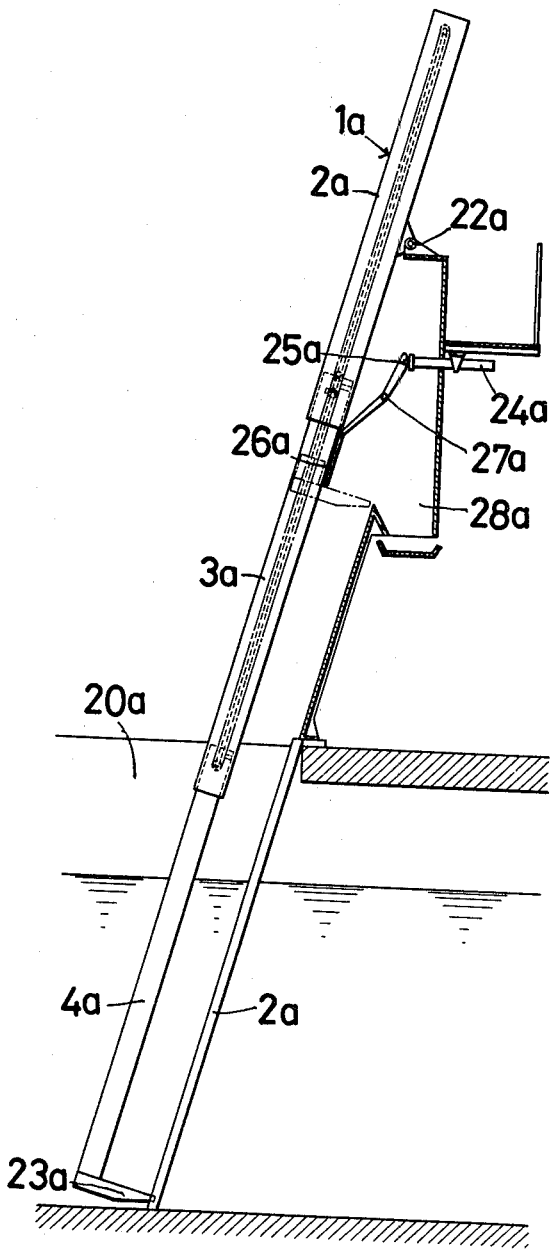
FIG. 8 is a longitudinal sectional side view of FIG. 7.

As shown in FIGS. 4 through 6, expansion and contraction conveyors 22, 23, 24 are provided in pipes 9, 10, 11 constituting the rake arm 5. The expansion and contraction moving means 22, 23, 24 may be chain conveyors each comprising a conveyor frame 25 consisting of a pair of plate members with a rotatable sprocket (a guide wheel) 26 mounted on each end thereof, an endless chain (an endless tension member) 27 being extended between said sprockets 26. Alternatively, the expansion and contraction conveyors 22, 23, 24 may be wire conveyors having endless wires extended between scored pulleys, respectively.

As shown in FIG. 4, the upper parts of conveyor frames 25 of the expansion and contraction moving means 23, 24 provided in the intermediate pipe 10 and the inner pipe 11 are secured thereto, respectively, so that the moving means, 23, 24 are supported by said pipes 10, 11. Upper sprocket spindles 28 of the expansion and contraction conveyors 23, 24 are connected with parts of the endless chains 27 of the upper moving means 22, 23, respectively, lower sprocket spindles 29 of the expansion and contraction moving means 22, 23 being connected with parts of the endless chains 27 of the lower expansion and contraction moving means 23, 24, respectively.

As shown in FIGS. 1 and 2, a transmission means 30 is provided between the upper sprocket spindle 28 of the expansion and contraction moving means 22 provided in the outer pipe 9 and the spindle 14 supported intermediately between the plate members 12, thereby enabling the rotation of the spindle 14 to be transmitted to the sprocket spindle 28 of the conveyor 22.

The length and the mounting position of the rack 20 should be carefully predetermined so that the rake arm 5 is contracted to the minimum when the wiper 7 is brought into contact with the upper surface of the rake claw 6, whilst the rake arm 5 is expanded to the maximum when the rake claw 6 is positioned in the lower part of the bar screen 2 as shown in FIG. 2.

The arm expansion and contraction system shown by the embodiment is of the construction as described hereinbefore. Referring to FIG. 2, if the rake arm 5 is pulled upwardly by the movement of the chain moving means 3 in the direction indicated by arrow, the spindle 14 is rotated with the pinion 19 meshing with the rack 20, the rotation of the spindle 14 being transmitted to the sprocket spindle 28 whereby the chain 27 of the expansion and contraction moving means 22 is rotated in the direction indicated by arrow in FIG. 4.

With the rotation of said chain 27, the upper sprocket 26 of the expansion and contraction moving means 23 provided in the intermediate pipe 10 is pulled upwardly, whereby the chain 27′ of the moving means 23 is also rotated in the arrow-indicated direction. With the rotation of said chain 27′, the upper sprocket 26 of the expansion and contraction conveyor 24 provided in the inner pipe 11 is pulled upwardly in turn. As a result of the rise of the sprocket 26, the chain 27″ is rotated in the direction indicated by arrow in FIG. 4, said inner pipe being displaced in the intermediate pipe 10 thereby causing the rake arm to contract.

Thus, the rake arm 5 contracts according as it rises until it contracts to the minimum when the rake claw 6 is brought into contact with the wiper 7. When the wiper 7 is pushed upwardly by the rising claw 6, said wiper oscillates thereby discharging the dust collected on the upper surface of the rake claw 6 into the chute 8.

When the joint between the chain 15 of the chain conveyor 3 and the link 13 has passed the upper sprocket 21 of said chain moving means 3, the rake arm 5 oscillates about the spindle 14 and moves downwardly with its lower end tilted leftwardly in FIG. 2.

In the course of the downward travel of the rake arm 5, the pinion 19 meshing with the rack 20 rotates in the reverse direction together with the expansion and contraction moving means 22, 23, 24 provided in the pipes 9, 10, 11, respectively, whereby the rake arm 5 is expanded in association with its downward movement.

Since the rake arm 5 is thus forced to expand and contract, the dust discharging operation can be conducted with reliability.

According to the embodiment, the rotation of the spindle is adapted to be transmitted to the upper sprocket by means of engagement between the rack and the pinion. However, the spindle of said upper sprocket may be adapted to be driven by a motor or the like.

As described hereinbefore, the embodiment has an advantage in that not only the expansible and contractible arm can be expanded and contracted with reliability, but also an increase in size of the apparatus can be precluded since it is of the construction in which the expansion and contraction moving means are provided in the respective pipes constituting the expansible and contractible arm. The embodiment has further advantage in that it is best suited for the expansion and contraction of the vertically reciprocating rake arm since the expansion and contraction moving means are adapted to be driven by the meshing between the rack and the pinion. A Second Embodiment As shown in FIGS. 7 through 11, the expansible and contractible arm 1 comprises a first, second and third square pipes 2a, 3a, 4a, the pipes 2a, 3a, 4a being assembled relatively slidably, a first and second moving means 6a, 7a being provided in the pipes 2a, 3a respectively with the exception of the third pipe 4a.

According to the embodiment, the moving means 6a, 7a comprise a frame 8a, a drive sprocket 9a provided at one end of the frame 8a, a guide sprocket 10a provided on the other end of the frame 8a, and an endless chain 11 extended between said two sprockets 9a, 10a.

Said conveyors 6a, 7a are provided in the pipes 2a, 3a with the drive sprockets 9a disposed on the upper side, respectively, the spindle 12a of the drive sprocket 9a of the first moving means 6a being supported by the upper part of the first pipe 2a. The lower part of the frame 8a of the first conveyor 6a is secured to a part of the chain 11a of the second conveyor 7a with interposition of a bracket 13a.

The upper part of the frame 8a of the second moving means 7a is secured to the upper part of the second pipe 3a with interposition of a pair of plate members 14a, a coupler 15a secured to one of said plate members 14a being secured to a part of the chain 11a of the first moving means 6a.

A coupler 16a is secured to the upper part of the third pipe 4a, said coupler 16a being secured to a part of the chain 11a of the second moving means 7a.

Figure 9:
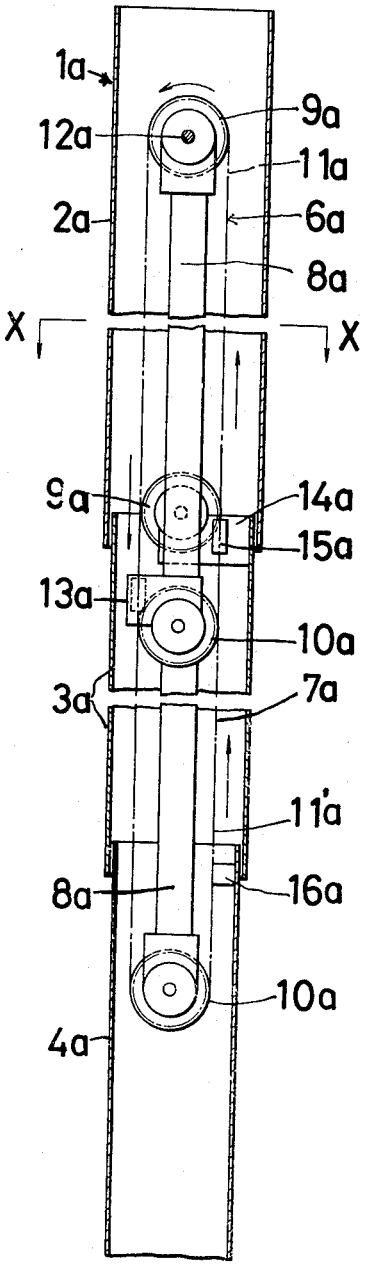
FIG. 9 is a longitudinal sectional elevation of the rake arm of FIG. 7.

The foregoing is the construction constituting the embodiment. If the drive sprocket 9a is rotated in the direction indicated by arrow in FIG. 7 by driving the sprocket spindle 12a of the first moving means 6a by means of a motor or the like, the chain 11a of the moving means 6a is rotated in the directions indicated by arrows in FIG. 7. Accordingly, the frame 8a of the second moving means 7a is pulled upwardly, whereby the second pipe 3a is displaced upwardly so as to be received by the first pipe 2a. Since a part of the chain 11a of the second moving means 7a secured to the frame 8a of the first moving means 6a is stationary, the right-hand vertical part 11a′ of the chain 11a of the moving means 7a is displaced in the arrow-indicated direction in association with the upward movement of the frame 8a of the second moving means 7a. With the upward travel of said vertical part 11a′, the third pipe 4a is displaced upwardly until the second pipe 3a is received by the first pipe 2a and the third pipe 4a is received by the second pipe 3a respectively, whereby the arm 1a is contracted as shown in FIG. 9.

If the sprocket spindle 12a is rotated in the reverse direction after the expansible and contractible arm 1a has been completely contracted, the first and second moving means 6a, 7a travel in the reverse direction, synchronously the second and third pipes 3a, 4a travelling downwardly thereby enabling the expansible and contractible arm 1a to expand.

As described hereinbefore, the embodiment has an advantage in that the expansion and contraction of the arm 1a is speedy since the second and third pipes 3a, 4a are displaced synchronously. It has a further advantage in that the apparatus can be assembled with simplicity due to its simple construction, that is, each moving means is provided in each pipe.

According to the embodiment shown in FIGS. 7 through 11, the expansible and contractible arm is constituted by the first, second and third pipes. The number of pipes, however, is not necessarily restricted to that of the embodiment. Furthermore, the endless chains of the conveyors may be replaced by endless wires, whilst the guide sprocket supported by the frame may be replaced by a semicircular guide face formed at the end of the frame thereby enabling to guide the travel of the endless chain.

Figure 10:
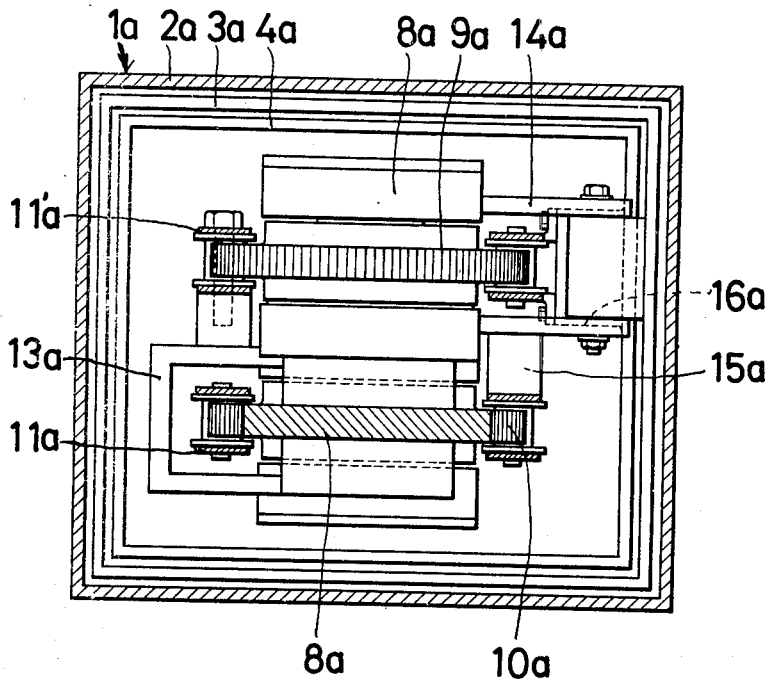
FIG. 10 is a sectional view taken along the line X—X of FIG. 9.
Figure 11:
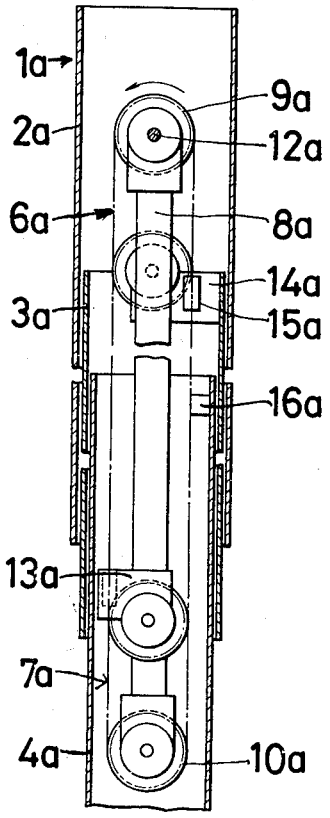
FIG. 11 is a longitudinal sectional elevation showing the state of contraction of the rake arm.

FIGS. 10 and 11 show an example of the use of the aforesaid expansible and contractible arm. A bar screen 21a is provided in an aqueduct 20a, an expansible and contractible arm 1a is provided upright on the upstream side of the bar screen 21a, a first pipe 2a on the upper side of the expansible and contractible arm 1a being supported by a bearing 22a, a rake claw 23a being secured to the lower part of a third pipe 4a. Thus, the dust collected by the bar screen 21a can be scraped upwardly above the aqueduct 20a with the upward movement of the rake claw 23a along the bar screen 21a caused by the contraction of the arm 1a, whilst the scraped dust can be discharged into a chute 28a by projecting a piston rod 25a beyond a cylinder 24a provided above the aqueduct 20a in the upper stop position of the rake claw 23a so that a wiper 26a oscillates about a spindle 27a.

Figure 12:
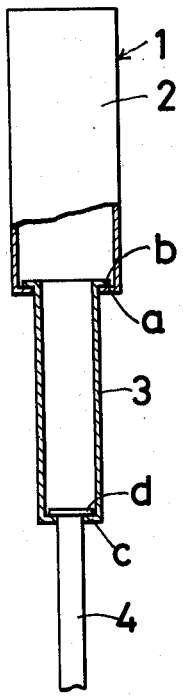
FIGS. 12 through 15 are longitudinal sectional views showing the principal parts of further embodiments of the arm expansion and contraction system according to the invention.

Referring to FIG. 12, the expansible and contractible arm 1a comprises a first, second and third pipes 2a, 3a, 4a having different diameters respectively and assembled relatively slidably. In order to preclude each pipe from slipping off downwardly, an inward flange (a) is formed at the lower end of the upper pipe 2a, whilst an outward flange (b) is formed at the upper end of the lower pipe 3a. Thus, the downward slip can be prevented by the engagement between the flanges (a) and (b). Similarly, the upper pipe 3a and the lower pipe 4a are provided with flanges (c) and (d) thereby enabling to prevent the pipe 4a from slipping off downwardly.

Figure 13:
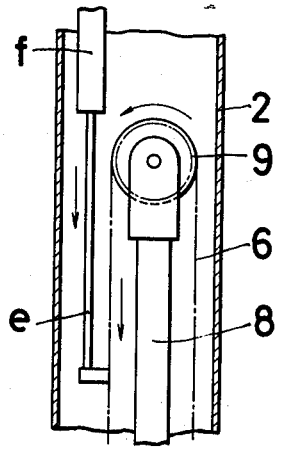
Figure 14:
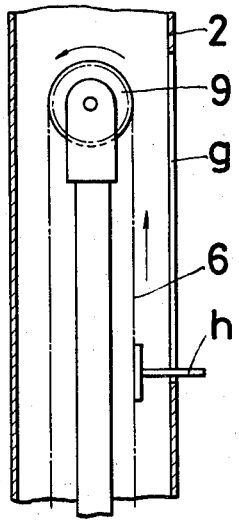
Figure 15:
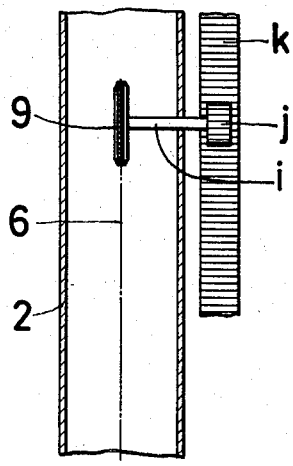

FIGS. 13 through 15 show still further embodiments of the expansion and contraction drive means for the expansible and contractible arm. FIG. 13 shows an expansion and contraction drive means for driving the terminal guide wheel 9b of the upper pipe 2b comprising a cylinder (f) with a projectable piston rod (e) provided in the pipe 2b, the forward end of the piston rod (e) being connected with an endless tension member 6b in the upper pipe 2b, the terminal guide wheel 9b being driven by the reciprocation of the piston rod (e) thereby enabling to expand and contract the lower pipes 3b, 4b.

FIG. 14 shows another expansion and contraction drive means for driving the terminal guide wheel 9b of the conveyor provided in the upper pipe 2 comprising an elongated hole (g) provided axially on the terminal pipe 2b, a lever (h) one end of which projects outwardly through said elongated hole (g) being connected at the other end thereof with the endless tension member 6b in the upper pipe so that the terminal guide wheel 9b is rotated by the slide of said lever (h) along the elongated hole (g) thereby enabling the lower pipes 3b, 4b to expand and contract.

FIG. 15 shows a still further example of expansion and contraction drive means wherein the spindle (i) of the terminal guide wheel 9b of the moving means provided in the upper pipe 2b is rotatably extended outwardly beyond the pipe 2b, a pinion (j) being formed at the end of the extended spindle, a rack (k) meshable with said pinion (j) being provided in the direction of expansion and contraction of the arm so that the terminal guide wheel 9b is rotated in assocation with the upward movement of the upper pipe thereby enabling the lower pipes 3b, 4b to expand and contract.

What is claimed is:

1. In an elongated dirt remover for submerging in an effluent, said dirt remover having upper and lower ends, a bar screen (2) extending between said ends, a rake claw (6) normally held at said dirt remover lower end, disposed for longitudinal movement between said dirt remover upper and lower ends along said screen to remove unwanted dirt deposited thereon, an elongated endless first moving means (15) including a drive therefor, said first moving means being disposed for connection to said rake claw (6) for moving said rake claw, and telescoping means with upper and lower ends coupling said rake claw (6) and said first moving means (15), in combination:

link means (12, 13, 17) including a driver (14) connecting said first moving means lower end to said telescoping means upper end; at least upper and lower telescoping pipes extending between said first moving means lower end and said rake claw, the outer periphery of one pipe being sized to just fit and slide within the inner periphery of the other pipe, and, cascaded second moving means with upper and lower ends disposed in at least two of said pipes, said second moving means (22, 23) each consisting of an endless tension member (27) extended between upper and lower guide wheels (26) one of the cascaded second moving means being longitudinally disposed in each pipe, the lower guide wheel of the upper of said cascaded second moving means being disposed adjacent to the second moving means of said lower telescoping pipes said lower guide wheel having a spindle fixed to a part of said endless tension member of said lower pipe, the guide wheel of the uppermost pipe having a spingle (28) coupled to said driver (14), by tranmission means (30), and, rack and pinion means (20, 19) operatively coupled to driver (14), spindle (28) and the transmission means (30) so as to telescope the pipes.

2. An apparatus as claimed in claim 1, wherein at least said lower pipe has an outward flange at the upper end thereof and said upper pipe has an inward flange at the lower end thereof so that the pipes are prevented from slipping off downwardly by the engagement of the respective flanges.

* * * * *